US009698506B2

(12) United States Patent
Miyake

(10) Patent No.: US 9,698,506 B2
(45) Date of Patent: Jul. 4, 2017

(54) ELECTRIC CONNECTION STRUCTURE

(71) Applicant: DENSO CORPORATION, Kariya, Aichi-pref. (JP)

(72) Inventor: Toshihiro Miyake, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/926,134

(22) Filed: Oct. 29, 2015

(65) Prior Publication Data

US 2016/0141782 A1 May 19, 2016

(30) Foreign Application Priority Data

Nov. 19, 2014 (JP) ..... 2014-234112

(51) Int. Cl.
*H01R 9/24* (2006.01)
*H01R 12/70* (2011.01)
*H01R 12/58* (2011.01)

(52) U.S. Cl.
CPC ..... *H01R 12/7076* (2013.01); *H01R 12/58* (2013.01)

(58) Field of Classification Search
CPC ..... H01R 12/7076
USPC ..... 439/884
See application file for complete search history.

(56) References Cited

U.S. PATENT DOCUMENTS 7,018,246 B2 * 3/2006 Raistrick ..... H01R 13/41 439/733.1
7,867,016 B2 * 1/2011 Nabilek ..... H01R 12/585 439/474
8,502,385 B2 * 8/2013 Oka ..... H01L 21/56 257/170
8,534,641 B2 * 9/2013 Schalowski ..... B60T 8/3675 251/129.15
8,690,586 B2 * 4/2014 Schneider ..... H01R 12/91 439/66
8,801,464 B2 * 8/2014 McNamara ..... H01R 13/6461 439/607.07
9,219,325 B2 * 12/2015 Endo ..... H01R 12/73
9,246,253 B1 * 1/2016 Defibaugh ..... H01R 12/523
2003/0220021 A1 * 11/2003 Whiteman, Jr. ... H01R 13/6587 439/607.08
2008/0158830 A1 * 7/2008 Tominaga ..... H05K 3/32 361/722
2010/0134979 A1 * 6/2010 Obiraki ..... H01L 23/3735 361/709

(Continued)

FOREIGN PATENT DOCUMENTS

JP S58-99779 U 7/1983
JP 2004-254359 A 9/2004

(Continued)

*Primary Examiner* — Tulsidas C Patel
*Assistant Examiner* — Peter G Leigh
(74) *Attorney, Agent, or Firm* — Posz Law Group, PLC

(57) ABSTRACT

An electric connection structure electrically connecting an electric device and a circuit board includes a connection terminal including a press-welded terminal portion welded to a device terminal of the electric device by pressing, and a press-fit terminal portion fitted in a through-hole of the circuit board by pressing. A direction of the pressing of the press-welded terminal portion against the device terminal is the same as a direction of the pressing of the press-fit terminal portion into the through-hole.

21 Claims, 11 Drawing Sheets

(56) References Cited

U.S. PATENT DOCUMENTS

| | | | | |
|---|---|---|---|---|
| 2011/0039428 | A1* | 2/2011 | Ludwig | H01R 12/585<br>439/82 |
| 2014/0087592 | A1* | 3/2014 | Endo | H01R 12/73<br>439/628 |

FOREIGN PATENT DOCUMENTS

| | | | |
|---|---|---|---|
| JP | 2005-026052 | A | 1/2005 |
| JP | 2008-304201 | A | 12/2008 |

* cited by examiner

ELECTRIC CONNECTION STRUCTURE

CROSS REFERENCE TO RELATED APPLICATION

This application is based on and incorporates herein by reference Japanese Patent Application No. 2014-234112 filed on Nov. 19, 2014.

TECHNICAL FIELD

The present disclosure relates to an electric connection structure that electrically connecting an electric device and a circuit board through a connection terminal.

BACKGROUND

Conventionally, a torque sensor disclosed in Patent Document 1 (JP 2008-304201 A) is known as an example of a technology regarding an electric connection structure which electrically connects an electric device, such as a motor, a motor generator, a solenoid or a sensor, to a circuit board through a connection terminal. The torque sensor includes a coil unit, a control board and multiple connection terminals. The multiple terminals are each obtained by bending a rectangular plate made of a conductive metal material into an L shape. The coil unit and the control board are electrically connected with each other by the respective connection terminals supported by a support member.

In the electric connection structure disclosed in Patent Document 1, an end (coil connection part) of the connection terminal is connected by crimping to a terminal of the coil unit, and the control board is disposed at a predetermined position. Subsequently, another end (board connection part) of the connection terminal is soldered to the control board while being inserted into a through-hole (connection hole) of the control board. In such electric connection structure, the connection of the coil unit and the control board is performed in two steps: a first step is the crimping connection between the end of the connection terminal and the terminal of the coil unit; and a second step is the soldering of the other end of the connection terminal to the control board after the insertion of the other end into the through-hole. Therefore, the number of steps of the connection may increase.

SUMMARY

It is an objective of the present disclosure to provide an electric connection structure capable of electrically connecting an electric device and a circuit board through a connection terminal without increase in the number of steps of the connection.

According to an aspect of the present disclosure, an electric connection structure electrically connects an electric device and a circuit board. The electric connection structure includes a connection terminal including a press-welded terminal portion welded to a device terminal of the electric device by pressing, and a press-fit terminal portion fitted in a through-hole of the circuit board by pressing. A direction of the pressing of the press-welded terminal portion against the device terminal is the same as a direction of the pressing of the press-fit terminal portion into the through-hole.

Accordingly, the press-welding of the press-welded terminal portion to the device terminal of the electric device and the press-fitting of the press-fit terminal portion into the through-hole of the circuit board can be performed simultaneously at the same step of pressing. Thus, connecting of one end of the connection terminal to the electric device and connecting of another end of the connection terminal to the circuit board are not need to be performed at separate steps. Therefore, the electric device and the circuit board can be electrically connected through the connection terminal without increase in the number of steps of the connection.

According to another aspect of the present disclosure, an electric connection structure electrically connects an electric device and a circuit board. The electric connection structure includes a connection terminal including a first press-fit terminal portion fitted in a press-fit hole of a device terminal of the electric device by pressing, and a second press-fit terminal portion fitted in a through-hole of the circuit board by pressing. A direction of the pressing of the first press-fit terminal portion into the press-fit hole is the same as a direction of the pressing of the second press-fit terminal portion into the through-hole.

Accordingly, the press-fitting of the first press-fit terminal portion into the through-hole of the device terminal of the electric device and the press-fitting of the second press-fit terminal portion into the through-hole of the circuit board can be performed simultaneously at the same step of pressing. Thus, connecting of one end of the connection terminal to the electric device and connecting of another end of the connection terminal to the circuit board are not need to be performed at separate steps. Therefore, the electric device and the circuit board can be electrically connected through the connection terminal without increase in the number of steps of the connection.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
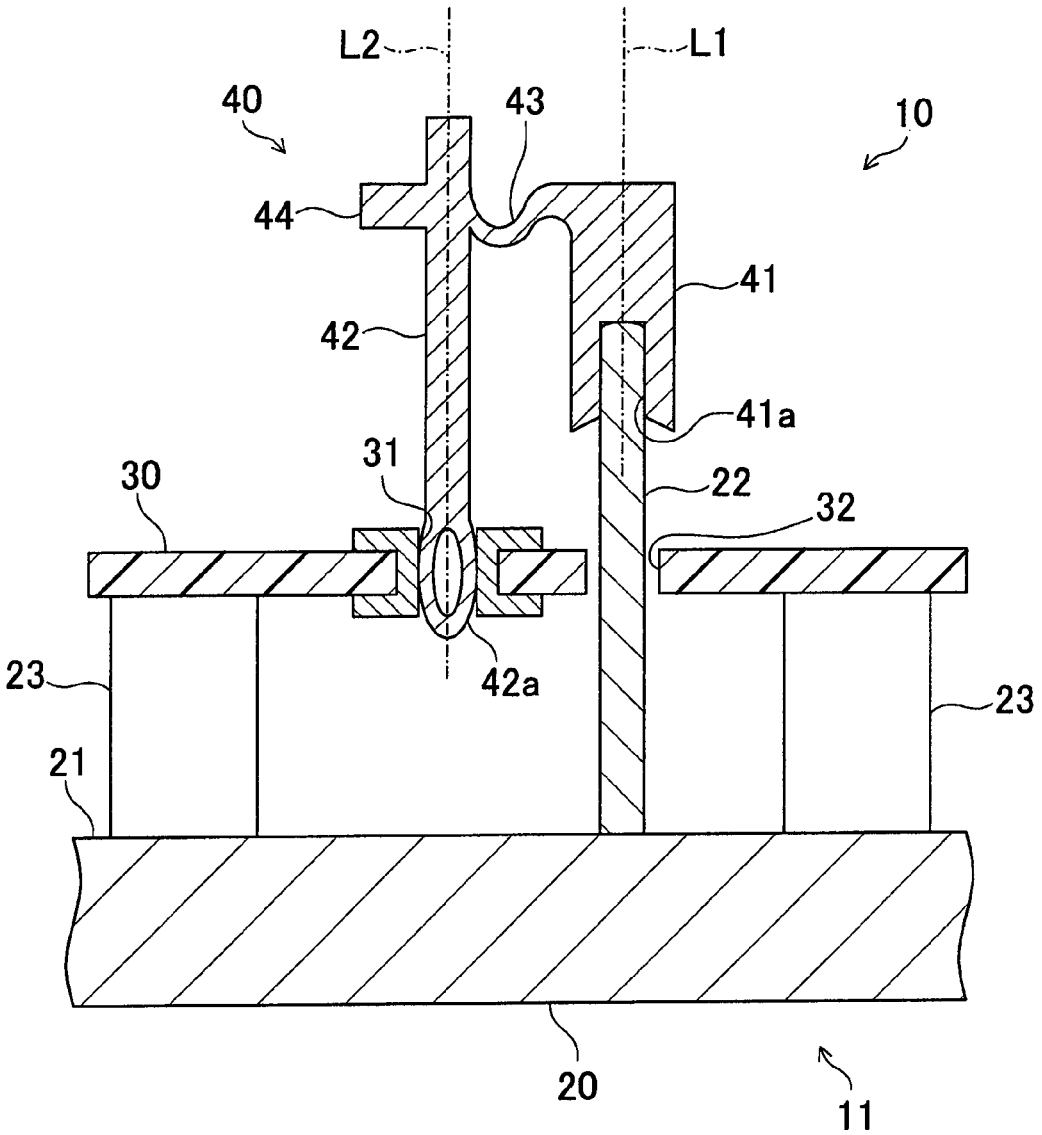
FIG. 1 is a schematic sectional diagram illustrating an electric connection structure according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

An electric connection structure 10 according to a first embodiment of the present disclosure will be described below, referring to the drawings.

An electric connection structure 10 according to the first embodiment is adopted as a structure electrically connecting an electric device and a circuit board through a connection terminal. More specifically, the electric connection structure 10 is, as shown in FIG. 1, used for an electronic device 11 in which an electric device 20 and a circuit board 30 are connected with each other through a connection terminal 40.

The electric device 20 is configured as an in-vehicle device mounted on a vehicle, and the electronic device 11 shown in FIG. 1 is configured as an in-vehicle mechatronic control device that controls the electric device 20 by using the circuit board 30. The electric device 20 is, for example, a motor, a motor generator or an actuator, and includes a housing 21 used as an outer shell of the electric device 20. Terminals 22 (hereinafter, referred to as "device terminals") for external connection are provided on a surface of the housing 21. Each terminal 22 has an approximately quadrangle shape and protrudes perpendicularly from the surface of the housing 21. Additionally, multiple bases 23 are provided on the surface of the housing 21 adjacent to the respective device terminals 22. The bases 23 support the circuit board 30 such that the circuit board 30 is kept at a predetermined position.

The circuit board 30 is configured as a multiple-layered board in which insulation layers made, for example, of an epoxy resin, and conductive layers made, for example, of cupper foil are stacked alternately. Mounted on a board surface of the circuit board 30 for controlling the electric device 20 or the like are an electronic component and a connector (not shown in the drawings), for example. The circuit board 30 includes through-holes 31 for electric connection with the electric device 20. The number of the through-holes 31 is the same as the number of the device terminals 22. Additionally, the circuit board 30 includes multiple insertion holes 32 into which the device terminals 22 are inserted, respectively, in a state where the circuit board 30 is supported by the bases 23. An inner diameter of each insertion hole 32 is set to be sufficiently larger than a diameter of each device terminal 22.

Figure 2A:
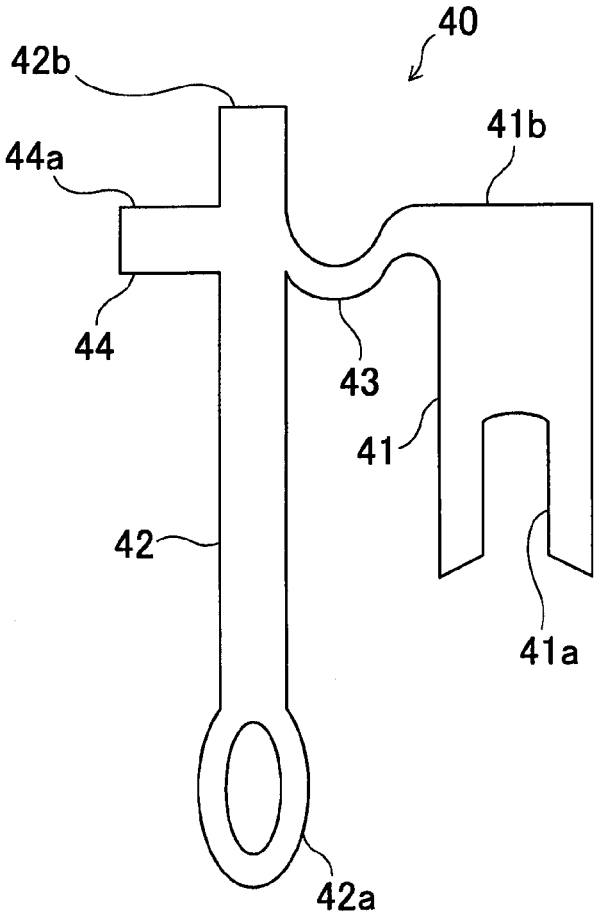
FIG. 2A is a front view illustrating a connection terminal of the electric connection structure according the first embodiment.
Figure 2B:
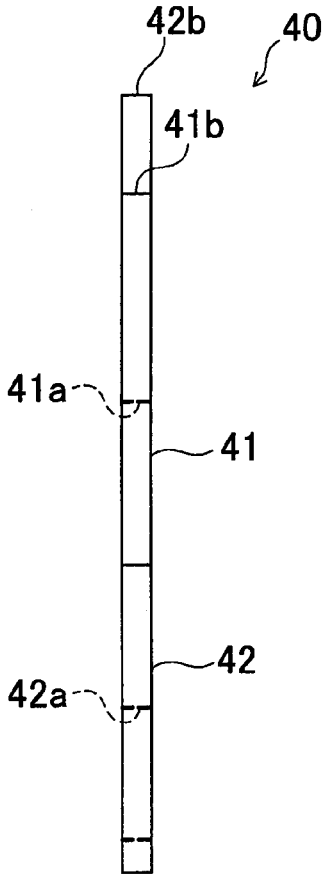
FIG. 2B is a side view illustrating the connection terminal of the electric connection structure according the first embodiment.

FIG. 2A is a front view illustrating the connection terminal 40, and FIG. 2B is a side view illustrating the connection terminal 40. The connection terminal 40 shown in FIGS. 2A and 2B is made from a conductive flat plate member such as a cupper plate by press working. The connection terminal 40 includes a press-welded terminal portion 41, a press-fit terminal portion 42 and a stress absorber 43 which have the same thickness as each other. As shown in FIG. 2B, the connection terminal 40 includes a single flat plate including the press-welded terminal portion 41, the press-fit terminal portion 42 and the stress absorber 43. Further, the connection terminal 40 may be a single flat plate as a whole.

The press-welded terminal portion 41 is provided for electric connection with the device terminal 22 of the electric device 20. A lower end of the press-welded terminal portion 41 has a slit 41*a* into which an end part of the device terminal 22 is inserted to be welded by pressing. A width of the slit 41*a* is slightly smaller than a diameter of the end part of the device terminal 22. An upper edge 41*b* of the press-welded terminal portion 41 is to be in contact with an assembly jig 50, and is perpendicular to a depth direction of the slit 41*a* (i.e. vertical direction in FIGS. 2A and 2B).

The press-fit terminal portion 42 is provided for electric connection with the through-hole 31 of the circuit board 30. An end part of the press-fit terminal portion 42 has an elastic part 42*a* fitted in the through-hole 31 by pressing. The elastic part 42*a* has a through-hole at a center part so as to have a frame shape enclosing the through-hole. Hence, the elastic part 42*a* is deformable elastically. A dimension (width) of the elastic part 42*a* is set to be slightly larger than an inner diameter of the through-hole 31.

A dimension of the press-fit terminal portion 42 in its longitudinal direction (i.e. the vertical direction in FIGS. 2A and 2B) is set such that the elastic part 42*a* is press-fitted in the through-hole 31 when the end part of the device terminal 22 is press-welded to the slit 41*a* of the press-welded terminal portion 41. An upper edge 42*b* of the press-fit terminal portion 42 is to be in contact with the assembly jig 50, and is perpendicular to the longitudinal direction of the press-fit terminal portion 42. The upper edge 41*b* of the press-welded terminal portion 41 and the upper edge 42*b* of the press-fit terminal portion 42 face in the same direction so as to be pressed by the assembly jig 50 simultaneously.

The longitudinal direction of the press-fit terminal portion 42 is parallel to the depth direction of the slit 41*a* of the press-welded terminal portion 41. Hence, a pressing direction of press-welding of the press-welded terminal portion 41 to the device terminal 22 is the same as a pressing direction of press-fitting of the press-fit terminal portion 42 to the thorough-hole 31. In other words, a first imaginary line L1 (first axis) extending along the pressing direction through a position where the press-welded terminal portion 41 is press-welded to the device terminal 22, as shown in FIG. 1, is parallel to a second imaginary line L2 (second axis) extending along the pressing direction through a position where the press-fit terminal portion 42 is press-fitted in the through-hole 31.

The stress absorber 43 (deformation absorber) is disposed between the press-welded terminal portion 41 and the press-fit terminal portion 42 and absorbs a stress (deformation) generated in the connection terminal 40. The press-welded terminal portion 41 and the press-fit terminal portion 42 are connected through the stress absorber 43. The stress absorber 43 includes a bent structure curved into an approximately U shape. Thus, the stress absorber 43 is located at a position other than on the first imaginary line L1 extending in the pressing direction through the press-welded terminal portion 41 and the second imaginary line L2 extending in the pressing direction through the press-fit terminal portion 42. If a stress absorber is positioned on the first imaginary line L1 extending in the pressing direction through the press-welded terminal portion 41 or the second imaginary line L2 extending in the pressing direction through the press-fit terminal portion 42, the stress absorber may be deformed unnecessarily at pressing step, and a pressing force in the pressing direction may not be transferred smoothly to the press-welded terminal portion 41 or the press-fit terminal portion 42.

The press-fit terminal portion 42 has a pressed protrusion 44 located adjacent to the upper edge 42*b*. An upper edge 44*a* of the pressed protrusion 44 is to be in contact with the assembly jig 50, and the upper edge 44*a* is coplanar with the upper edge 41*b* of the press-welded terminal portion 41. The pressed protrusion 44 is located on a side of the press-fit terminal portion 42 that is opposite from the press-welded terminal portion 41.

Figure 3:
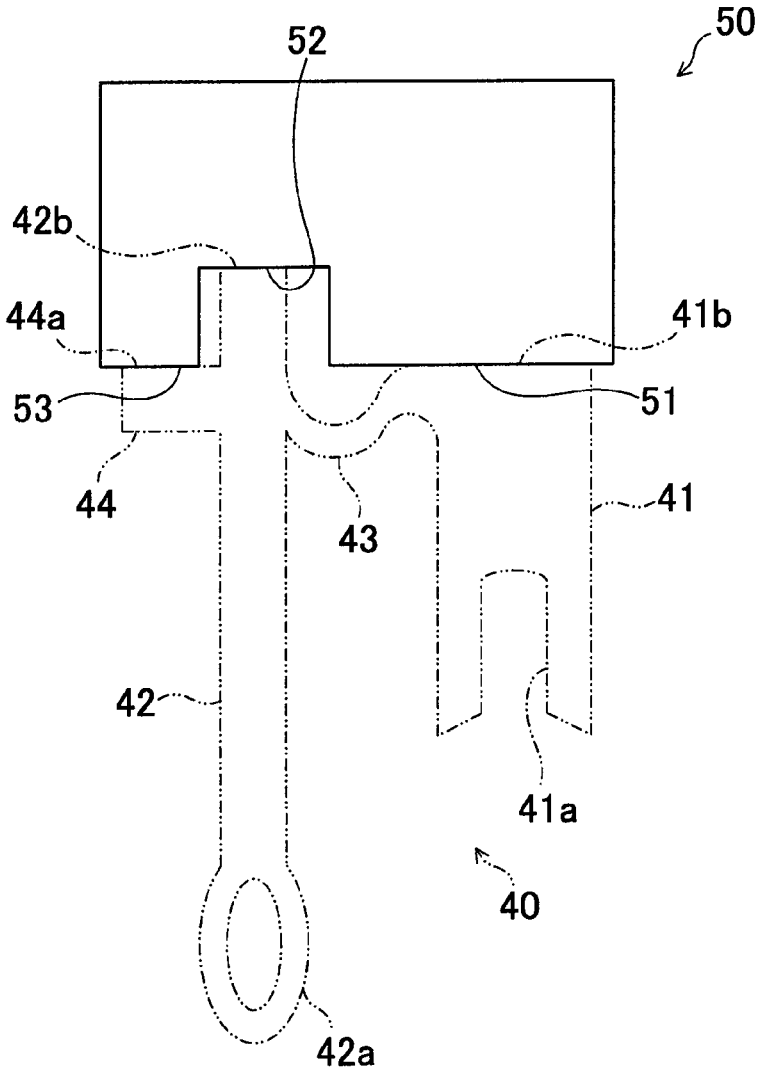
FIG. 3 is a front view illustrating an assembly jig for the electric connection structure according to the first embodiment.
Figure 4:
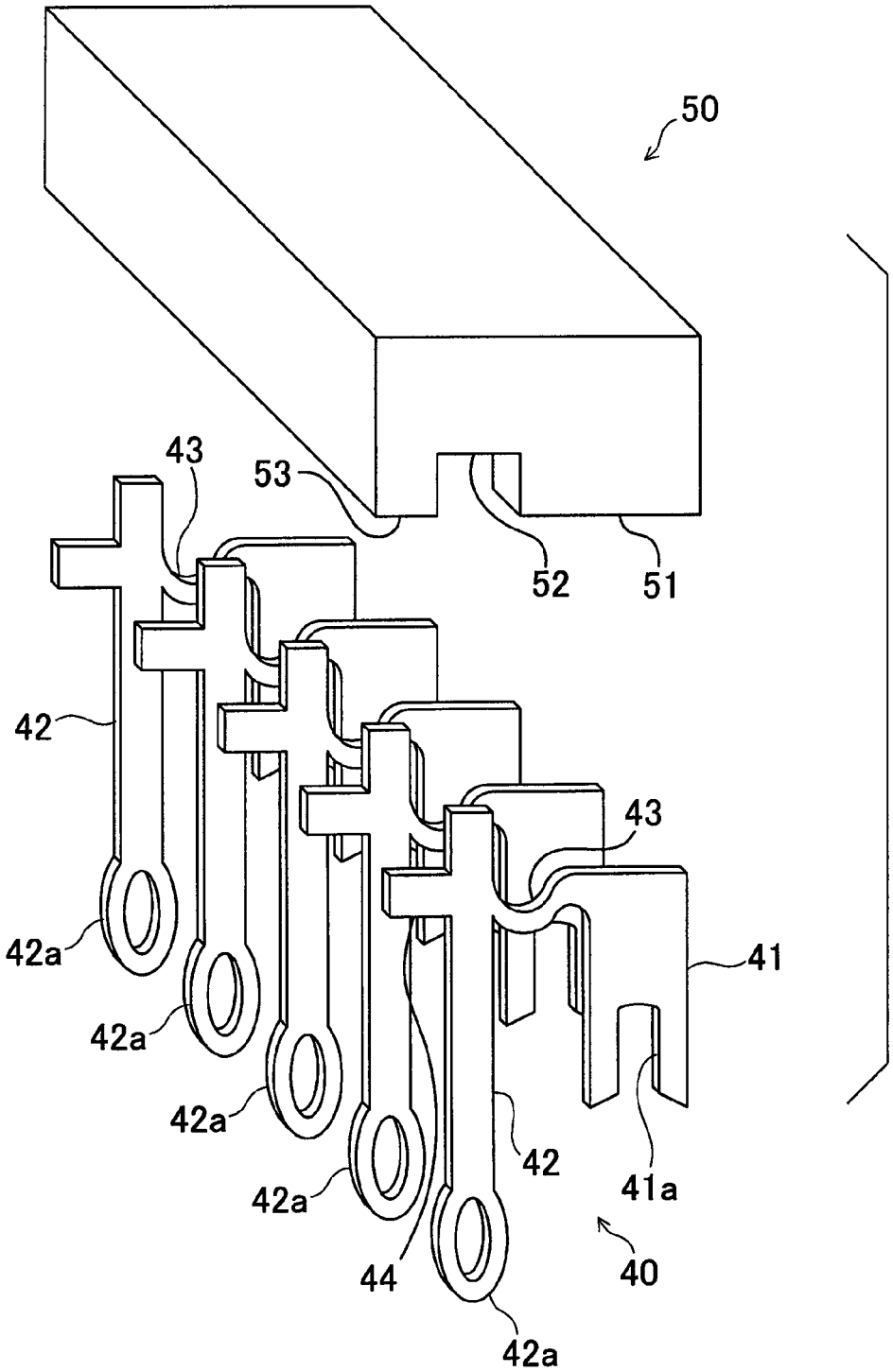
FIG. 4 is a perspective view illustrating a state before each connection terminal is attached to the assembly jig, according to the first embodiment.
Figure 5:
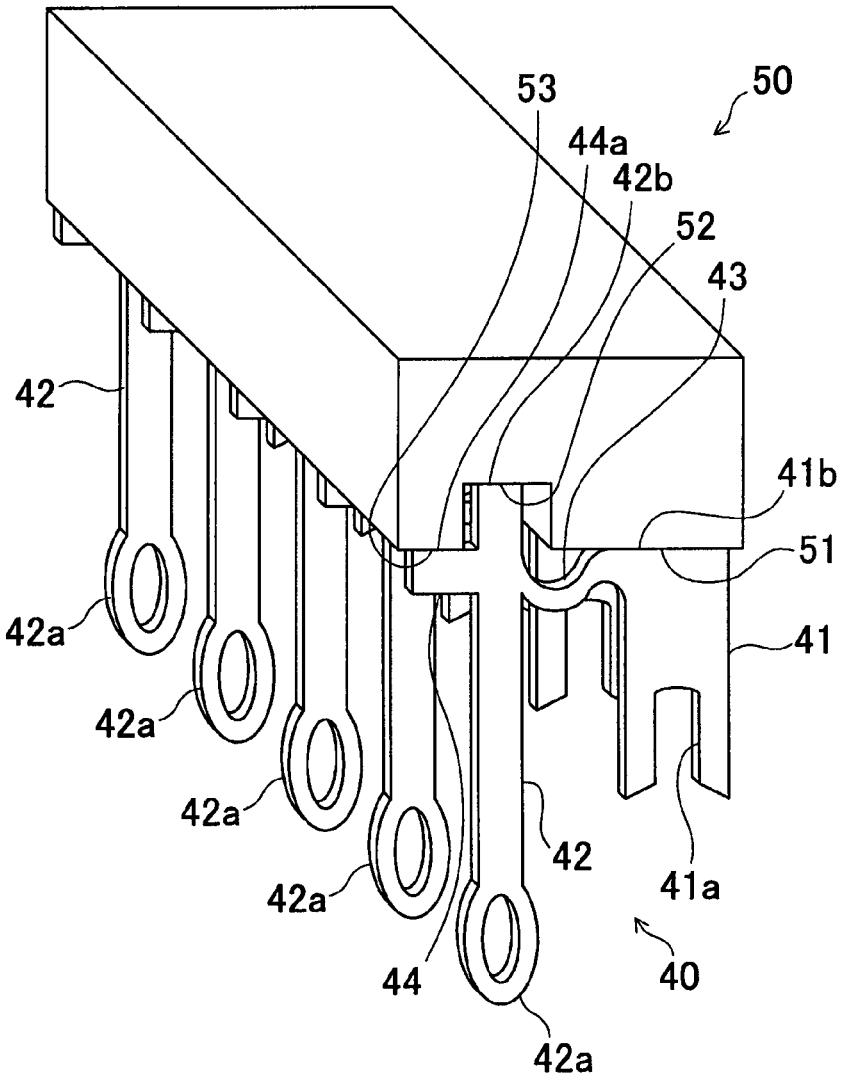
FIG. 5 is a perspective view illustrating a state where each connection terminal is attached to the assembly jig, according to the first embodiment.

FIG. 3 is a front view illustrating the assembly jig 50. FIG. 4 is a perspective view illustrating a state before each connection terminal 40 is attached to the assembly jig 50. FIG. 5 is a perspective view illustrating a state in which each connection terminal 40 is attached to the assembly jig 50. In FIG. 3, the connection terminal 40 is shown by an alternate long and a dashed-two dotted line. FIGS. 4 and 5 illustrate a case where five connection terminals 40 are attached to the assembly jig 50.

The assembly jig 50 shown in FIG. 3 is a jig used for electric connection of the connection terminals 40 to the electric device 20 and the circuit board 30. The assembly jig 50 is capable of holding the multiple connection terminals 40 to be separated by a predetermined distance from each other. For example, a magnetic force may be adopted as a force of the assembly jig 50 to hold the connection terminals 40.

The assembly jig 50 is configured to apply a pressing force to the respective connection terminals 40 held by the assembly jig 50 so as to press the connection terminals 40 against the electric device 20 and the circuit board 30. A lower end 51, a lower end 52 and a lower end 53 of the assembly jig 50 are to be in contact, respectively, with the upper edge 41*b*, the upper edge 42*b* and the upper edge 44*a*.

Therefore, as shown in FIG. 4, the respective connection terminals 40, which are separated by a predetermined distance from each other, are arranged to face to the assembly jig 50, and subsequently, as shown in FIG. 5, the respective connection terminals 40 can be held by the assembly jig 50 such that the upper edge 41*b*, the upper edge 42*b* and the upper edge 44*a* of each connection terminal 40 are in contact with the lower end 51, the lower end 52 and the lower end 53 of the assembly jig 50, respectively.

Figure 6:
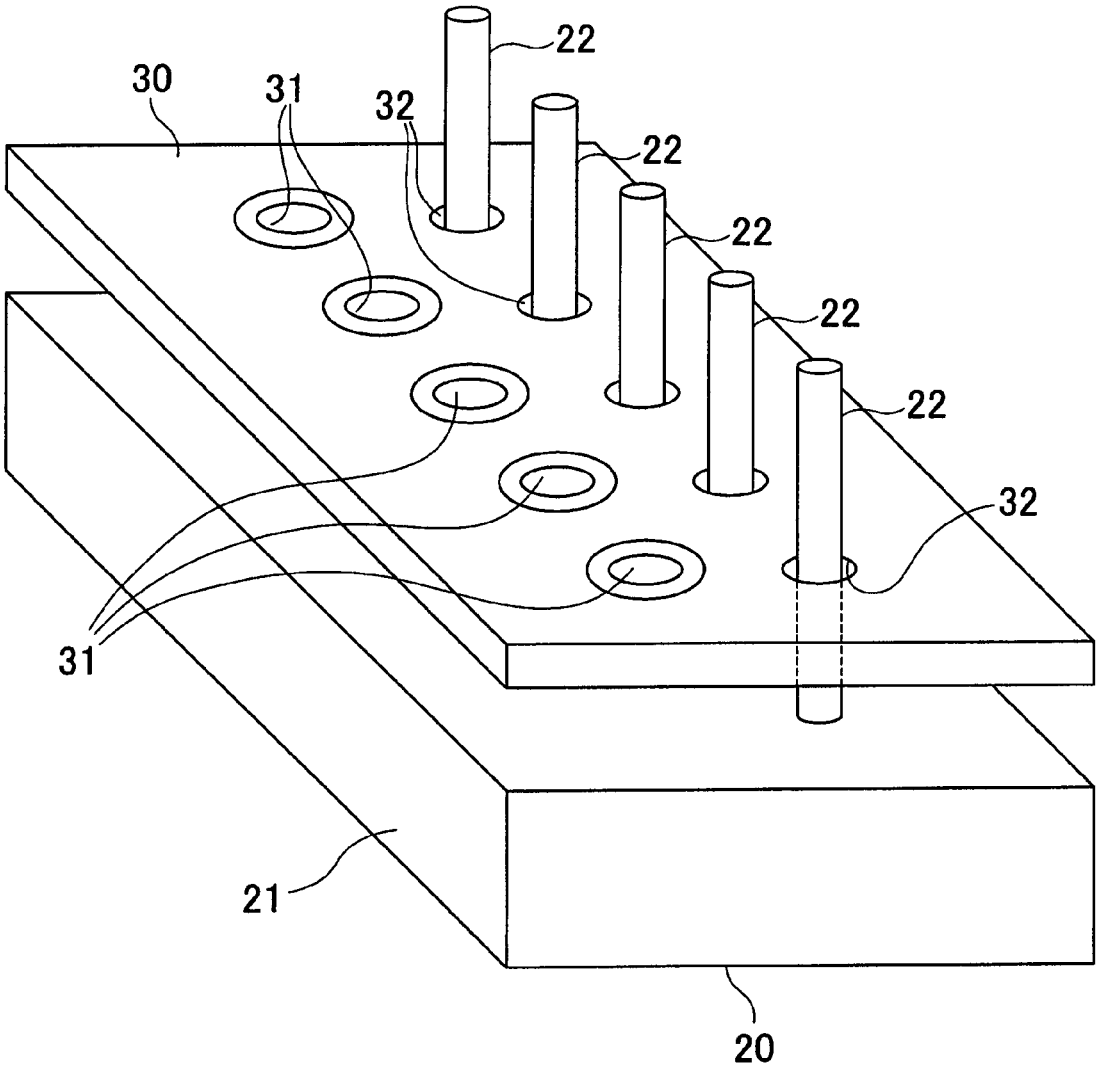
FIG. 6 is a perspective view illustrating a state where the circuit board is attached to the electric device, according to the first embodiment.
Figure 7:
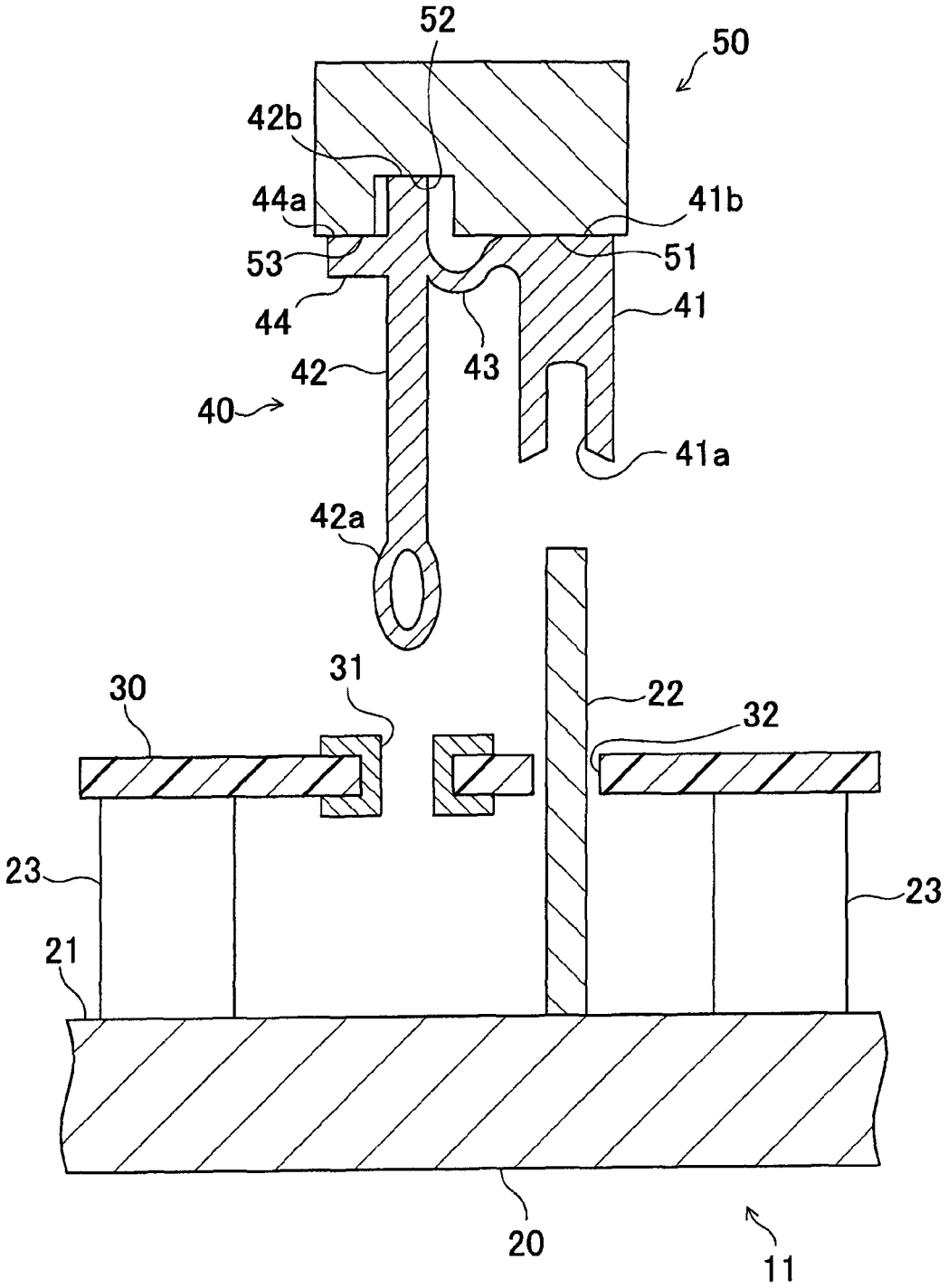
FIG. 7 is a sectional diagram illustrating a state before the connection terminals are connected to the electric device and the circuit board, according the first embodiment.
Figure 8:
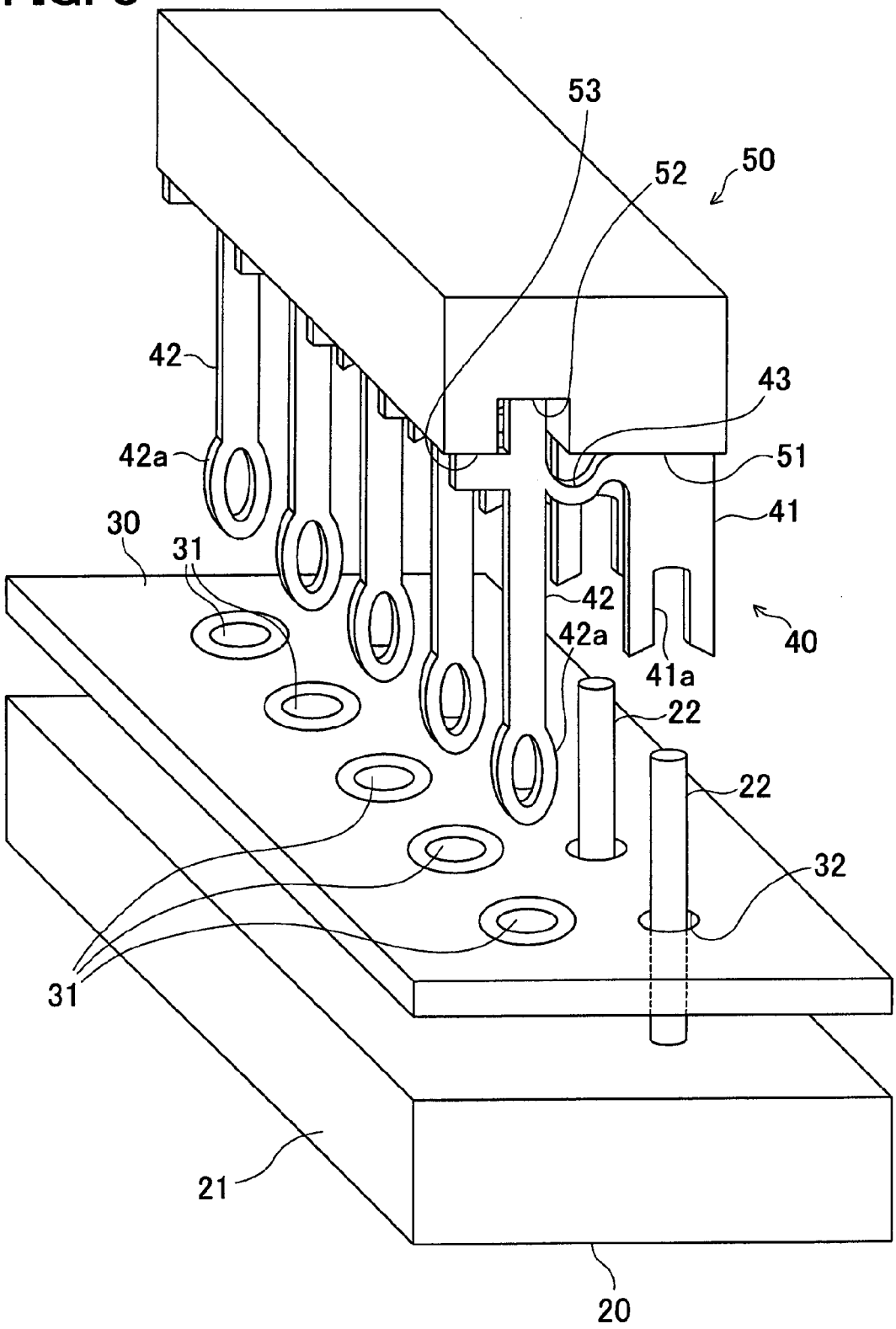
FIG. 8 is a perspective view illustrating the state before the connection terminals are connected to the electric device and the circuit board, according the first embodiment.
Figure 9:
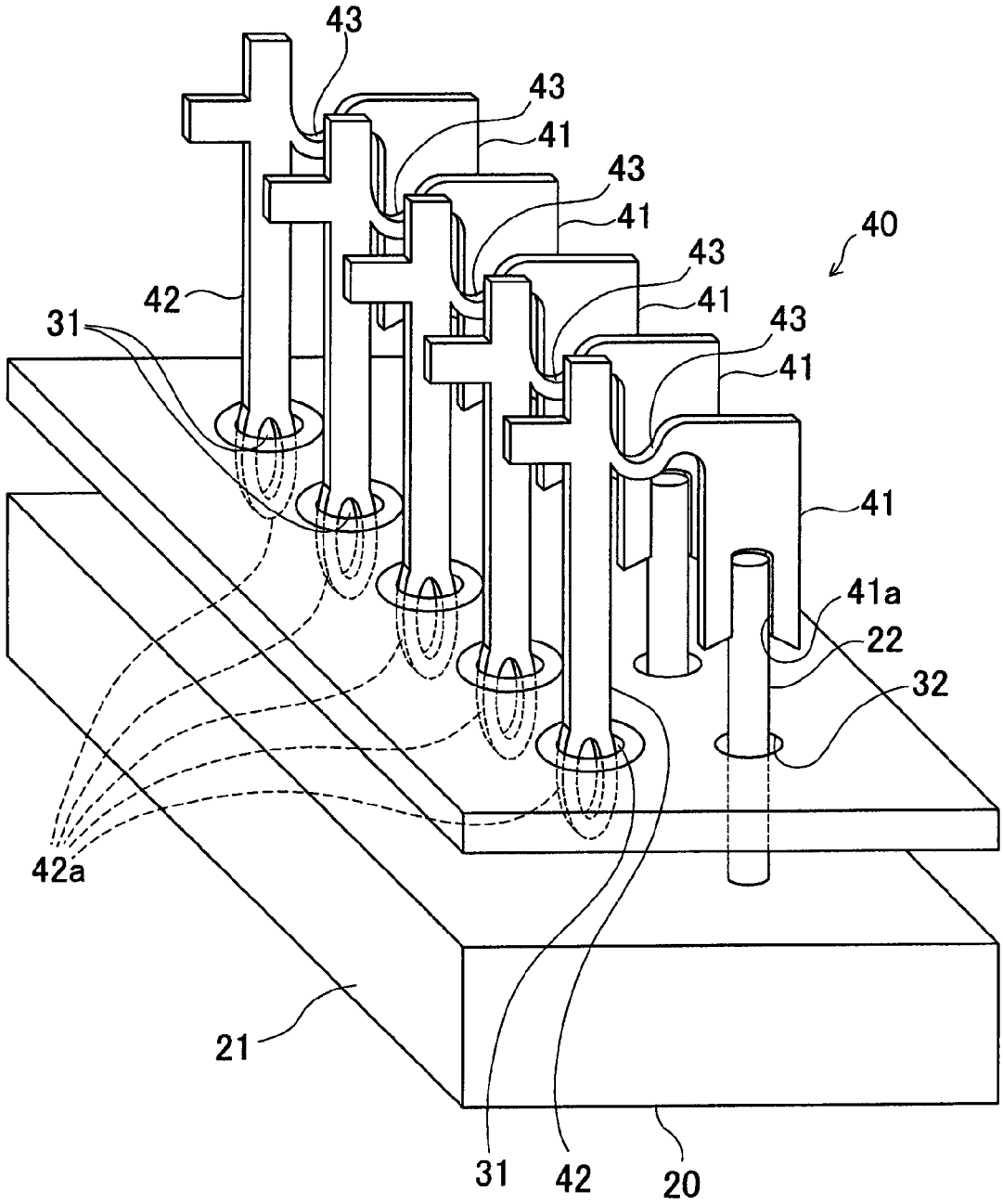
FIG. 9 is a perspective view illustrating a state where the connection terminals are connected to the electric device and the circuit board, according the first embodiment.

Next, a process of electrical connection of the electric device 20 and the circuit board 30 by using the connection terminals 40 having the above-described configuration will be described with reference to the drawings. FIG. 6 is a perspective view illustrating a state where the circuit board 30 is attached to the electric device 20. FIG. 7 is a sectional diagram illustrating a state before the connection terminals 40 are attached to the electric device 20 and the circuit board 30. FIG. 8 is a perspective view illustrating the state before the connection terminals 40 are attached to the electric device 20 and the circuit board 30. FIG. 9 is a perspective view illustrating a state where the connection terminals 40 are attached to the electric device 20 and the circuit board 30. FIGS. 6, 8 and 9 illustrate a part of the circuit board 30 and a part of the electric device 20 in the vicinity of the through-holes 31 and the insertion holes 32, and do not illustrate the other electronic components, for the sake of convenience.

First, the electric device 20 and the circuit board 30, having the above-described configurations, are prepared. Next, the circuit board 30 is moved close to the electric device 20 such that the device terminals 22 are inserted into the corresponding insertion holes 32. The circuit board 30 is fastened to the bases 23, and accordingly a surface of the circuit board 30 which faces to the electric device 20 is supported and held by the bases 23. Therefore, as shown in FIG. 6, the circuit board 30 is fixed at a predetermined position with respect to the electric device 20. Additionally, as shown in FIG. 5, the connection terminals 40 are held by the assembly jig 50.

As shown in FIGS. 7 and 8, the connection terminals 40 held by the assembly jig 50 is arranged such that the press-welded terminal portion 41 and the press-fit terminal portion 42 of each connection terminal 40 face to the corresponding device terminal 22 and the corresponding through-hole 31, respectively. Subsequently, the connection terminals 40 are subjected to a pressing force in the above-described pressing direction via the assembly jig 50, and accordingly, as shown in FIG. 9, the press-welded terminal portion 41 is pressed against and welded to the device terminal 22 in the slit 41*a* while the elastic part 42*a* of the press-fit terminal portion 42 is pressed and fitted in the through-hole 31. In other words, the press-welding of the press-welded terminal portion 41 to the device terminal 22 and the press-fitting of the press-fit terminal portion 42 to the through-hole 31 are performed simultaneously at the same pressing step by applying the pressing force to the connection terminals 40 in the above-described pressing direction.

Therefore, the electric device 20 and the circuit board 30 are electrically connected with each other through the respective connection terminals 40. In this state, a difference in thermal expansivity may be caused between the electric device 20 and the circuit board 30 by heat cycle or the like, and a stress may occur due to the thermal expansivity difference in a connection part between the press-welded terminal portion 41 and the device terminal 22 or in a connection part between the press-fit terminal portion 42 and the through-hole 31. In this case, the stress absorber 43 disposed between the press-welded terminal portion 41 and the press-fit terminal portion 42 absorbs the above-described stress in accordance with the bent structure of the stress absorber 43. Hence, the above-described connection parts can be prevented from being subjected to an excessive stress.

As described above, according the electric connection structure 10 of the present embodiment, the connection terminal 40 includes the press-welded terminal portion 41 that is pressed against and welded to the device terminal 22 of the electric device 20, and a press-fit terminal portion 42 that pressed and fitted in the through-hole 31 of the circuit board 30. The connection terminal 40 is configured such that the direction (L1) of the pressing of the press-welded terminal portion 41 against the device terminal 22 is the same as the direction (L2) of the pressing of the press-fit terminal portion 42 into the through-hole 31.

Accordingly, the press-welding of the press-welded terminal portion 41 to the device terminal 22 of the electric device 20 and the press-fitting of the press-fit terminal portion 42 to the through-hole 31 of the circuit board 30 can be performed simultaneously at the same pressing step. Hence, there is no need to perform connection of one end of the connection terminal 40 to the electric device 20 and connection of another end of the connection terminal 40 to the circuit board 30 at separate steps. The electric device 20 and the circuit board 30 can be electrically connected with each other through the connection terminals 40 without increase in the number of steps of the connection.

The stress absorber 43 is provided between the press-welded terminal portion 41 and the press-fit terminal portion 42 and absorbs a stress generated in the connection terminal 40. Hence, the connection part between the press-welded terminal portion 41 and the device terminal 22 and the connection part between the press-fit terminal portion 42 and the through-hole 31 can be prevented from being subjected to an excessive stress. Consequently, a connection structure having a high reliability can be configured with respect to the electric connection using the connection terminal 40.

The stress absorber 43 is arranged at a position other than on the first imaginary line L1 extending in the pressing direction through the position where the press-welded terminal portion 41 is press-welded to the device terminal 22, and the second imaginary line L2 extending in the pressing direction through the position the press-fit terminal portion 42 press-fitted in the through-hole 31. Thus, the above-described pressing forces, applied to the press-welded terminal portion 41 and the press-fit terminal portion 42 via the assembly jig 50, are not directly applied to the stress absorber 43. Unnecessary deformation of the stress absorber 43 in the connection process can be avoided.

The connection terminal 40 includes the single flat plate including the press-welded terminal portion 41, the press-fit terminal portion 42 and the stress absorber 43. Hence, the connection terminal 40 can be formed from a flat conductive plate member such as a cupper plate by press working only. When the connection terminal 40 is formed, the flat conductive plate member does not need to be deformed to be curved. Therefore, a manufacturing cost of the connection terminal 40 can be reduced.

Figure 10:
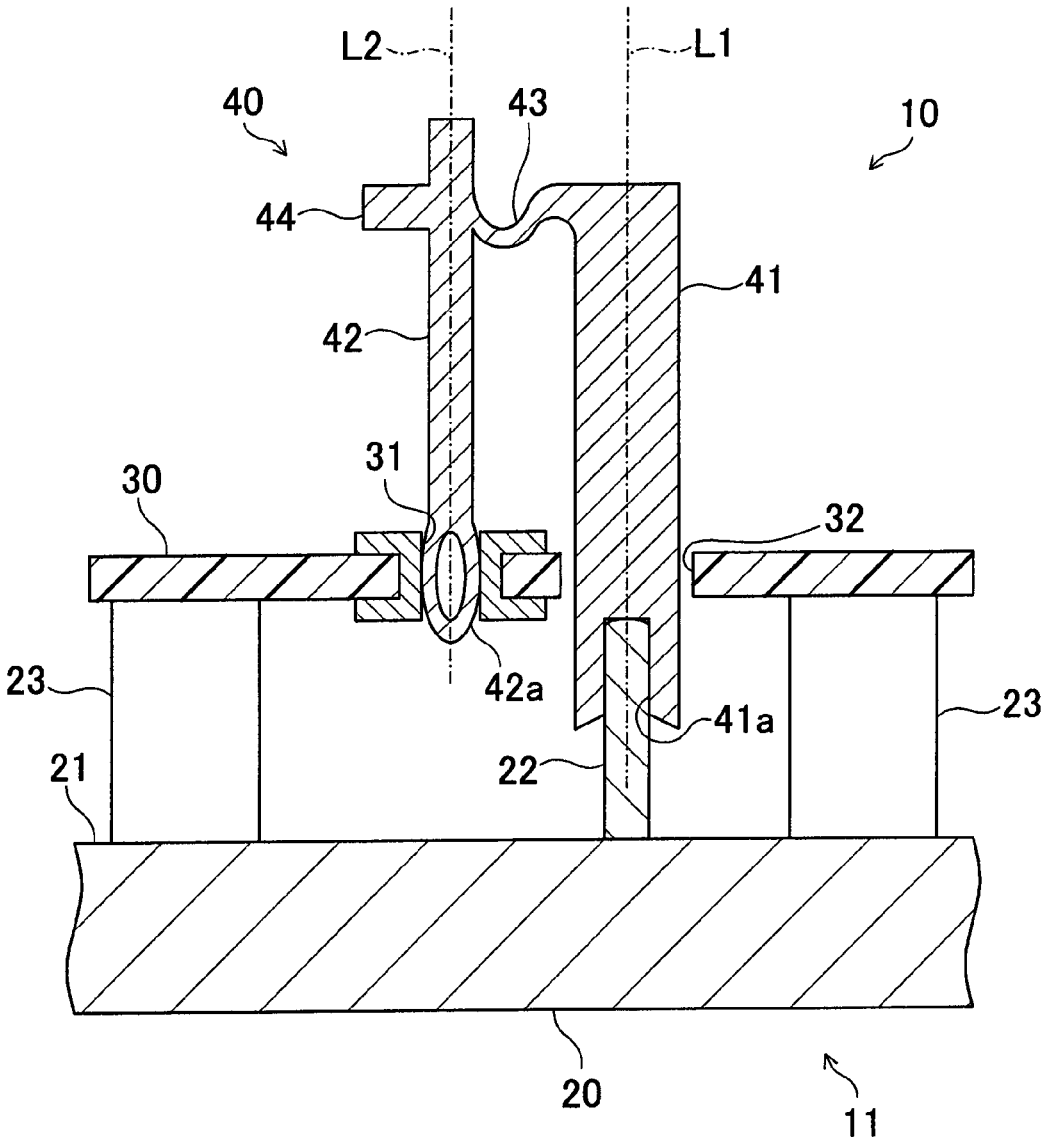
FIG. 10 is a sectional diagram illustrating an electric connection structure according to a modification of the first embodiment.

FIG. 10 is a sectional diagram illustrating an electric connection structure 10 according to a first modification of the first embodiment. The connection terminal 40 is not limited to the configuration in which the press-welded terminal portion 41 is press-welded in the slit 41*a* to an end of the device terminal 22 that is inserted into the insertion hole 32. The press-welded terminal portion 41 may be modified into another shape to be pressed against and welded to the device terminal 22 by the pressing force in the pressing direction. For example, as shown in FIG. 10, a press-welded terminal portion 41 may be pressed against and welded to a device terminal 22 while the press-welded terminal portion 41 is inserted into the insertion hole 32.

Second Embodiment

Figure 11:
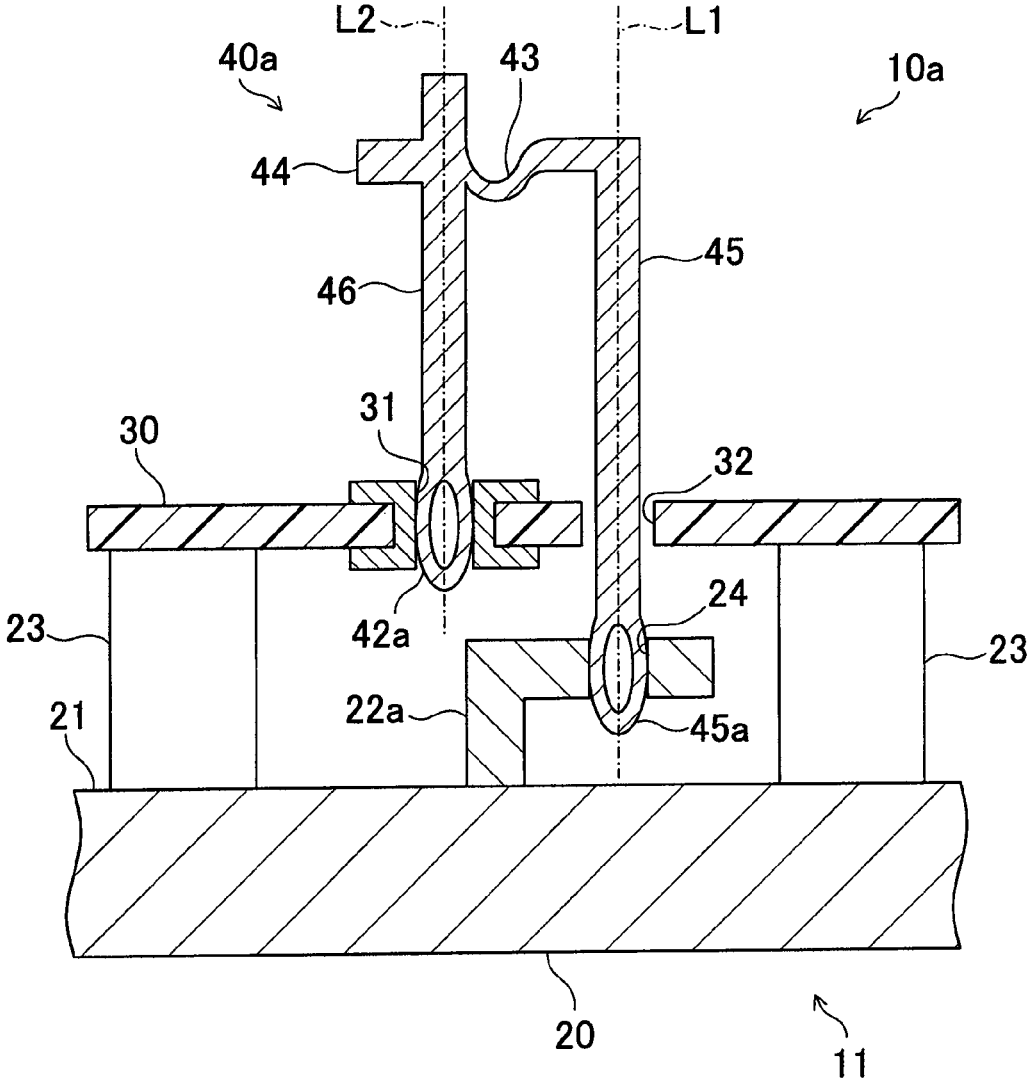
FIG. 11 is a sectional diagram illustrating an electric connection structure according to a second embodiment of the present disclosure.

Next, an electric connection structure 10*a* according to a second embodiment of the present disclosure will be described referring to FIG. 11. FIG. 11 is a sectional diagram illustrating the electric connection structure 10*a* according to the second embodiment.

In the second embodiment, it is mainly different from the above-described first embodiment that both ends of a connection terminal 40*a* have press-fit structures. Therefore, a part substantially the same as a part of the first embodiment will be assigned the same numeral as the part of the first embodiment, and an explanation of the part will be omitted in the second embodiment.

As shown in FIG. 11, the connection terminal 40*a* of the electric connection structure 10*a* according to the present embodiment includes a first press-fit terminal portion 45 and a second press-fit terminal portion 46 while the connection terminal 40 of the first embodiment includes the press-welded terminal portion 41 and the press-fit terminal portion 42. The second press-fit terminal portion 46 has the same shape as the press-fit terminal portion 42 of the first embodiment.

The first press-fit terminal portion 45 is provided for electrical connection with a press-fit hole 24 provided in a device terminal 22*a* of an electric device 20. An end part of the first press-fit terminal portion 45 has an elastic part 45*a* that is fitted in the press-fit hole 24. The elastic part 45*a* has a through-hole at a center part so as to have a frame shape enclosing the through-hole. Hence, the elastic part 45*a* is deformable elastically. A dimension (width) of the elastic part 45*a* is set to be slightly larger than an inner diameter of the press-fit hole 24.

A dimension of the first press-fit terminal portion 45 in its longitudinal direction is set such that the elastic part 45*a* inserted into an insertion hole 32 of a circuit board 30 is press-fitted in the press-fit hole 24 when an elastic part 42*a* of the second press-fit terminal portion 46 is press-fitted in a through-hole 31.

A stress absorber 43 described above is arranged between the first press-fit terminal portion 45 and the second press-fit terminal portion 46 and absorbs a stress generated in the connection terminal 40*a*. The connection terminal 40*a* is made from a conductive flat plate member such as a cupper plate by press working. Thus, the connection terminal 40*a* includes the first press-fit terminal portion 45, the second press-fit terminal portion 46 and the stress absorber 43 which have the same thickness as each other. Similar to the above-described connection terminal 40, the connection terminal 40*a* includes a single flat plate including the first press-fit terminal portion 45, the second press-fit terminal portion 46 and the stress absorber 43. Further, the connection terminal 40*a* may be a single flat plate as a whole.

Even in the electric connection structure 10*a*, the press-fitting of the first press-fit terminal portion 45 to the press-fit hole 24 of the device terminal 22*a* of the electric device 20 and the press-fitting of the second press-fit terminal portion 46 to the through-hole 31 of the circuit board 30 can be performed simultaneously at the same pressing step. Hence, there is no need to perform connection of one end of the connection terminal 40*a* to the electric device 20 and connection of another end of the connection terminal 40*a* to the circuit board 30 at separate steps. The electric device 20 and the circuit board 30 can be electrically connected with each other through the connection terminal 40*a* without increase in the number of steps of the connection.

The stress absorber 43 is provided between the first press-fit terminal portion 45 and the second press-fit terminal portion 46 and absorbs a stress generated in the connection terminal 40*a*. Hence, a connection part between the first press-fit terminal portion 45 and the press-fit hole 24 and a connection part between the second press-fit terminal portion 46 and the through-hole 31 can be prevented from being subjected to an excessive stress. Consequently, a connection structure having a high reliability can be configured with respect to the electric connection using the connection terminal 40*a*.

The stress absorber 43 is, similarly to the first embodiment, arranged at a position other than on a first imaginary line L1 and a second imaginary line L2. The first imaginary line L1 extends in the pressing direction through a position where the first press-fit terminal portion 45 is press-fitted in the press-fit hole 24 of the device terminal 22*a*. The second imaginary line L2 extends in the pressing direction through a position where the second press-fit terminal portion 46 is press-fitted in the through-hole 31. Thus, the above-described pressing forces, applied to the first press-fit terminal portion 45 and the second press-fit terminal portion 46 via an assembly jig 50, are not directly applied to the stress absorber 43. Unnecessary deformation of the stress absorber 43 in the connection process can be avoided.

The connection terminal 40*a* includes the single flat plate including the first press-fit terminal portion 45, the second press-fit terminal portion 46 and the stress absorber 43. Hence, the connection terminal 40*a* can be formed from a flat conductive plate member such as a cupper plate by press working only. When the connection terminal 40*a* is formed, the flat conductive plate member does not need to be deformed to be curved. Therefore, a manufacturing cost of the connection terminal 40*a* can be reduced.

Although the present disclosure has been fully described in connection with the preferred embodiments thereof with reference to the accompanying drawings, it is to be noted that various changes and modifications will become apparent to those skilled in the art. The present invention is not limited to the above-described embodiments or the modification. For example, the present invention may be realized as below.

The stress absorber 43 is not limited to the bent structure having the approximately U shape. The stress absorber 43 may be formed into a structure functioning to absorb a stress (deformation) generated in the connection terminal 40, 40*a*. For example, the stress absorber 43 may have a bent structure having an approximately S shape.

The number of the connection terminals 40, 40*a* electrically connecting the electric device 20 and the circuit board 30 is five in the above-described embodiments and modification, but the number of the connection terminals 40, 40*a* is not limited. The electric device 20 and the circuit board 30 may be electrically connected with each other through one or more connection terminal 40, 40*a*.

The electric connection structure 10, 10*a* according to the present disclosure is not limited to the connection structure which connects the electric device 20 configured as an in-vehicle device and the circuit board 30 and may be applied to a connection structure which connects an electric device of another electronic equipment and a circuit board.

Additional advantages and modifications will readily occur to those skilled in the art. The disclosure in its broader terms is therefore not limited to the specific details, representative apparatus, and illustrative examples shown and described.

What is claimed is:

1. An electric connection structure electrically connecting an electric device and a circuit board, the electric connection structure comprising a connection terminal including:

a first press-fit terminal portion including a first end part that is electrically connected to and is press-fitted onto a device terminal of the electric device, and the first press-fit terminal portion extending from the first end part in an extension direction away from the electric device and terminating at a first edge surface, the first edge surface stretching approximately perpendicularly to the extension direction;

a second press-fit terminal portion including a second end part fitted into a through-hole of the circuit board, the second press-fit terminal portion extending from the second end part and alongside and approximately parallel to the extension direction of the first press-fit terminal portion and terminating at a second edge surface, the second edge surface stretching approximately perpendicularly to the extension direction; and a pressed protrusion protruding from a side edge surface of the second press-fit member portion and having a third edge surface stretching approximately perpendicularly to the extension direction and in a direction facing away from the first press-fit terminal portion, wherein the first end part of the first press-fit terminal portion and the second end part of the second press-fit terminal portion are located on a same side of the electric device, and a distance between the second edge surface and the second end part of the second press-fit terminal portion in the extension direction is longer than a distance between the third edge surface and the second end part of the second press-fit terminal portion in the extension direction.

2. The electric connection structure according to claim 1, wherein the connection terminal further includes a stress absorber provided between the first press-fit terminal portion and the second press-fit terminal portion, and the stress absorber absorbs a stress generated in the connection terminal.

3. The electric connection structure according to claim 2, wherein the stress absorber is located at a position other than on a first imaginary line and a second imaginary line, the first imaginary line extends along the pressing direction through a position where the first press-fit terminal portion is press-fitted onto the device terminal, and the second imaginary line extends along the pressing direction through a position the second press-fit terminal portion press-fitted into the through-hole.

4. The electric connection structure according to claim 2, wherein the connection terminal includes a single flat plate including the first press-fit terminal portion, the second press-fit terminal portion and the stress absorber.

5. The electric connection structure according to claim 2, wherein the first press-fit terminal portion and the second press-fit terminal portion are connected through the stress absorber, and the stress absorber has a curved shape.

6. The electric connection structure according to claim 2, wherein the stress absorber extends below the first edge surface of the first press-fit terminal and the third edge surface of the second press-fit terminal in the extension direction.

7. The electric connection structure according to claim 1, wherein the first edge surface of the first press-fit terminal portion and the third edge surface of the second press-fit terminal portion are coplanar and extend approximately perpendicularly to the extension direction.

8. The electric connection structure according to claim 7, wherein a distance between the first edge surface and the first end part of the first press-fit terminal portion in the extension direction is shorter than a distance between the third edge surface and the second end part of the second press-fit terminal portion in the extension direction.

9. The electric connection structure according to claim 7, wherein a distance between the first edge surface and the first end part of the first press-fit terminal portion in the extension direction is longer than a distance between the third edge surface and the second end part of the second press-fit terminal portion in the extension direction.

10. The electric connection structure according to claim 1, wherein the electric device and the circuit board extend approximately parallel to each other, and the extension direction is approximately perpendicular to a surface of the electric device.

11. The electric connection structure according to claim 1, wherein the third edge surface of the second press-fit terminal is offset in the extension direction from the second edge surface of the second press-fit member.

12. An electric connection structure electrically connecting an electric device and a circuit board, the electric connection structure comprising a connection terminal including:

a first press-fit terminal portion including a first end part that is fitted in a press-fit hole of a device terminal of the electric device, the first press-fit terminal portion extending from the first end part in an extension direction and away from the electric device and terminating at a first edge surface, the first edge surface stretching approximately perpendicularly to the extension direction;

a second press-fit terminal portion including a second end part fitted in a through-hole of the circuit board, the second press-fit terminal portion extending from the second end part and alongside and approximately parallel to the extension direction of the first press-fit terminal portion and terminating at a second edge surface, the second edge surface stretching approximately perpendicularly to the extension direction; and a pressed protrusion protruding from a side edge surface of the second press-fit member portion and having a third edge surface stretching approximately perpendicularly to the extension direction and in a direction facing away from the first press-fit terminal portion, wherein the first end part of the first press-fit terminal portion and the second end part of the second press-fit terminal portion are located on a same side of the electric device, and a distance between the second edge surface and the second end part of the second press-fit terminal portion in the extension direction is longer than a distance between the third edge surface and the second end part of the second press-fit terminal portion in the extension direction.

13. The electric connection structure according to claim 12, wherein the connection terminal includes a stress absorber provided between the first press-fit terminal portion and the second press-fit terminal portion, and the stress absorber absorbs a stress generated in the connection terminal.

14. The electric connection structure according to claim 13, wherein the stress absorber is located at a position other than on a first imaginary line and a second imaginary line, the first imaginary line extends along the pressing direction through a position where the first press-fit terminal portion is press-fitted in the press-fit hole, and the second imaginary line extends along the pressing direction through a position where the second press-fit terminal portion is press-fitted in the through-hole.

15. The electric connection structure according to claim 13, wherein the connection terminal includes a single flat plate including the first press-fit terminal portion, the second press-fit terminal portion and the stress absorber.

16. The electric connection structure according to claim 13, wherein the stress absorber extends below the first edge surface of the first press-fit terminal and the third edge surface of the second press-fit terminal in the extension direction.

17. The electric connection structure according to claim 12, wherein the first edge surface of the first press-fit terminal portion and the third edge surface of the second press-fit terminal portion are coplanar and extend approximately perpendicularly to the extension direction.

18. The electric connection structure according to claim 17, wherein a distance between the first edge surface and the first end part of the first press-fit terminal portion in the extension direction is shorter than a distance between the third edge surface and the second end part of the second press-fit terminal portion in the extension direction.

19. The electric connection structure according to claim 17, wherein a distance between the first edge surface and the first end part of the first press-fit terminal portion in the extension direction is longer than a distance between the third edge surface and the second end part of the second press-fit terminal portion in the extension direction.

20. The electric connection structure according to claim 12, wherein the electric device and the circuit board extend approximately parallel to each other, and the extension direction is approximately perpendicular to a surface of the electric device.

21. The electric connection structure according to claim 12, wherein the third edge surface of the second press-fit terminal is offset in the extension direction from the second edge surface of the second press-fit member.

* * * * *